United States Patent [19]

Armstrong

[11] 3,970,397

[45] July 20, 1976

[54] BUSINESS CARD SYSTEM

[76] Inventor: Terrance R. Armstrong, 3710 S. Grand Ave., Los Angeles, Calif. 90007

[22] Filed: Mar. 6, 1975

[21] Appl. No.: 555,816

[52] U.S. Cl. ..... 402/79; 402/501; 40/360

[51] Int. Cl.[2] ..... B42F 3/00

[58] Field of Search ..... 402/79, 50, 80 R; 281/38; 283/66 R, 21; 40/360

[56] References Cited

UNITED STATES PATENTS

| | | | |
|---|---|---|---|
| 958,008 | 5/1910 | Razall | 402/79 |
| 1,172,010 | 2/1916 | Cooke | 402/79 |
| 1,428,102 | 9/1922 | Kelly | 402/79 X |
| 1,429,436 | 9/1922 | Kelly | 402/79 X |
| 1,567,406 | 12/1925 | Wilke | 402/79 X |
| 2,213,666 | 9/1940 | Burke | 283/21 |
| 2,321,184 | 6/1943 | Butterworth | 283/21 |
| 2,852,278 | 9/1958 | Dere | 402/79 X |
| 2,955,849 | 10/1960 | Schussler | 283/66 R |

FOREIGN PATENTS OR APPLICATIONS

| | | | |
|---|---|---|---|
| 674,668 | 5/1966 | Belgium | 402/79 |
| 1,105,800 | 3/1968 | United Kingdom | 402/79 |
| 537,845 | 7/1941 | United Kingdom | 402/79 |

*Primary Examiner*—Jerome Schnall
*Attorney, Agent, or Firm*—Julius Rubinstein

[57] ABSTRACT

The business information is carried in a field having the area of a standard business card, e.g. 2 × 3½ inches, on a larger card, e.g. 3 × 5 inches. Perforations or markings provided on the card predetermine where areas of the large card are to be severed from the remainder to size the resulting card for use with any of several card filing systems By preference, a plurality of parallel ones of the perforations or markings and an adjacent edge are bordered with generally T-shaped slots so the resulting card may be filed on standard roll, wheel and arched tray-type index card holders of a plurality of different size formats.

5 Claims, 8 Drawing Figures

BUSINESS CARD SYSTEM

BACKGROUND OF THE INVENTION

Many business people give out calling cards, especially sales people and others whose businesses and professions bring them into direct contact with the people they serve or depend upon or wish to establish relations with. Most calling cards given out wind up forgotten in a desk drawer and are eventually cleaned out and discarded.

Some offices maintain card files of various sorts. In those it is sometimes the custom for the information received on calling cards to be copied onto a card and filed in the system. In the process, delay is inherent and information is sometimes transposed or otherwise incorrectly copied. In other instances, the calling card is stapled to or otherwise bodily inducted into the particular office filing system.

The system of the invention is particularly suited for use with roll, wheel or arched tray-type filing card holders. These are in wide use and are available from a number of suppliers.

Rol-O-Dex holders are supplied in roll, covered wheel and arched tray forms. Another arched tray-type holder for dual slotted-T type cards is supplied by Eldon Office Products of Los Angeles, Calif. 90045. Another wheel-type holder names as supplier Zephyr American Corp., New York, New York. Other wheel-type holders bear the name Wheeldex, Inc., Peekskill, N.Y. 10566 and lists as relating to the dual T-slotted filing cards and the holders therefor, the following United States patents:

| Patentee | Patent Number | Issue Date |
|---|---|---|
| Scholfield | 2,046,655 | July 7, 1936 |
| Scholfield | 2,205,932 | June 25, 1940 |
| Scholfield | 2,231,029 | February 11, 1941 |
| Hayes | 2,286,911 | June 16, 1942 |
| Scholfield | 2,316,489 | April 13, 1943 |
| Scholfield | 2,332,606 | October 26, 1943 |
| Scholfield | 2,413,078 | December 24, 1946 |
| Scholfield | Re.22,765 | June 11, 1946 |
| Scholfield | 2,493,167 | January 3, 1950 |
| Houghtaling | 2,484,033 | October 11, 1949 |
| Scholfield | 2,500,709 | March 14, 1950 |

The suppliers of looseleaf address books (e.g. Recordplate of El Monte, Calif.), binders, 3 × 5 card index file trays, drawers and boxes, plastic pocket card holders, are too numerous to mention and their products are ubiquitous in our culture.

SUMMARY OF THE INVENTION

The business information is carried in a field having the area of a standard business card, e.g. 2 × 3½ inches, on a larger card, e.g. 3 × 5 inches. Perforations or markings provided on the card predetermine where areas of the large card are to be severed from the remainder to size the resulting card for use with any of several card filing systems. By preference, a plurality of parallel ones of the perforations or markings and an adjacent edge are bordered with generally T-shaped slots so the resulting card may be filed on standard roll, wheel and arched tray-type index card holders of a plurality of different size formats.

The card may also bear one or more rows of punchings for ring binding and/or temporarily inactivated adhesive material-bearing regions on one card face.

Accordingly, the same large card may be filed in Rol-O-Dex, Wheeldex, Eldon, Zephyr and like dual T-slotted filing card holders, in filing card trays, drawers and boxes, in plastic pockets, ring binders, looseleaf address files and the like. In making one call, the business person or other card bearer, can quickly accommodate the card he leaves at a call to the size and type of filing system in use at the place called on. This substantially increases the likelihood the business information on the card will be speedily and correctly entered on the card-receiver's address or calling card index holder.

Figure 1:
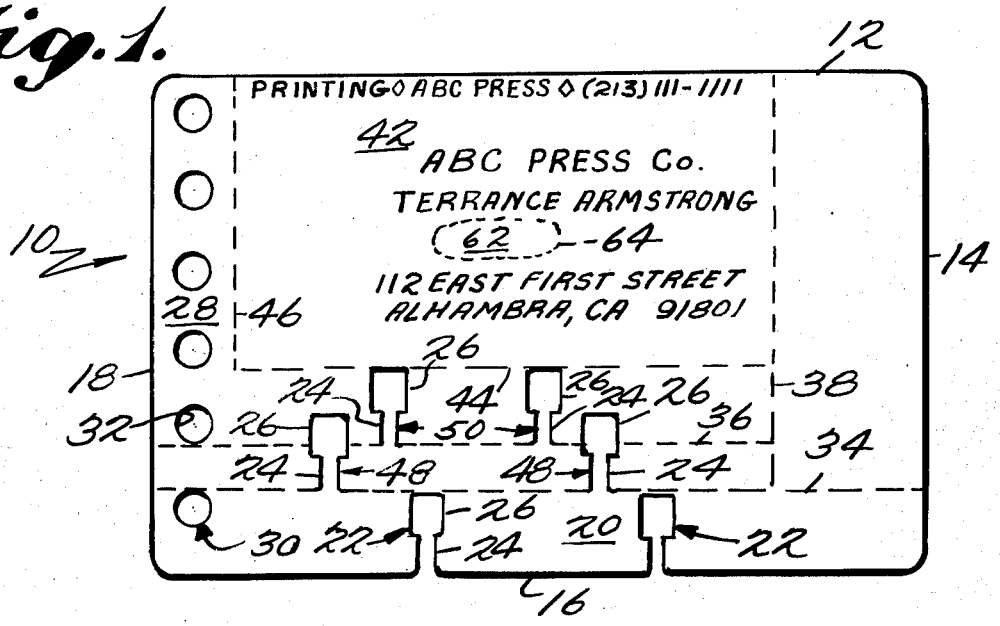
FIG. 1 is a plan view of a large format (e.g. three × five) card provided with elements of the present invention, with elaborations showing other preferred characteristics.

Of course, the particular sizes disclosed herein are for example only. As can be seen from the appended claims, less than all of the features shown in the drawings are essential to practices of the invention disclosed herein.

DETAILED DESCRIPTION

In FIG. 1, the card 10 is of large format, e.g. 3 × 5 inches. It is bounded by the top or "north", "east", "south" or bottom and "west" or side edges 12, 14, 16, 18. (These arbitrarily assigned designations of position assume the orientation of the card shown in FIG. 1 for convenience of description, and do not express an essential orientation of the card.)

The south or bottom border 20, adjacent and joining the south edge 16 is provided with a pair of T-shaped slots 22, spaced equal distances from one another from the north-south extending transverse centerline of the large format card 10.

Each T-shaped slot 22 has a relatively narrow neck region 24 which joins the edge 16 and extends northwards to a head portion 26 of generally rounded-corner square shape whereby the card 10 is held by its bottom edge.

The west or side border 28, adjacent the west edge 18 is provided with a row 30 of ring binder-accommodating holes 32 for holding the cards in filing devices by their side edge.

One popular size of ring bound address book (e.g. available from Recordplate Co.) makes use of 2½ × 5 inch cards. Accordingly, a line of perforations 34 is provided on the large format card 10 parallel to the south edge 16. To adjust the large format card for use with the 2½ × 5 inch card-accepting binder, the south border 20 is severed from the card along the line of perforation 34 defining a third rectangular area including the second rectangular area, as further described below.

Figure 4:
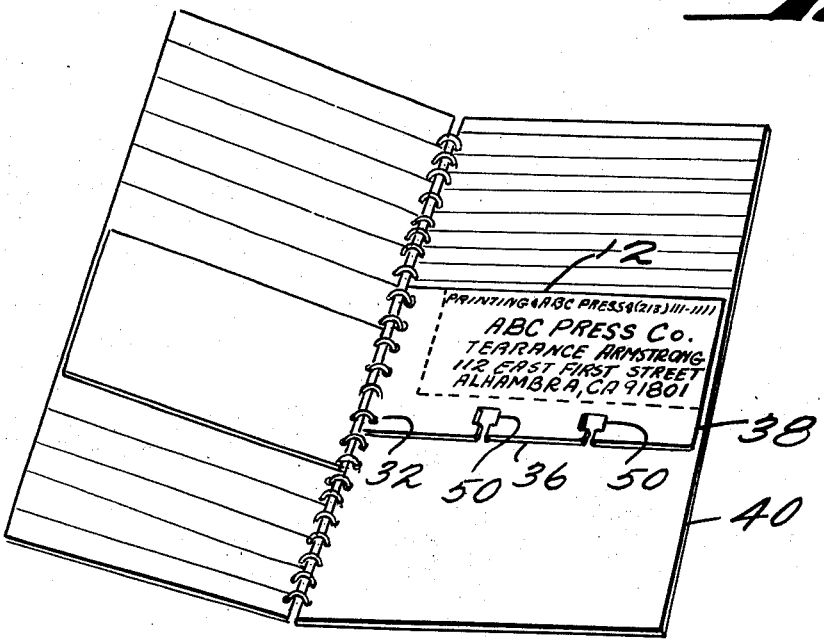
FIG. 4 shows a perspective view of a ring binder-type holder supplied with a card resulting from severing portions of the card shown in FIG. 1.

Another line of perforations 36 is provided parallel to the south edge 16 and a line of perforations 38 is provided parallel to the east edge 14. When the south and east border portions are severed from the card along the lines of perforations 36 and 38 and defining a second rectangular area including the first rectangular area, as further described below, the resulting card measures 2½ × 3⅜, and the remaining holes 32 of the remainder of the row 30 permit the remaining card to be filed by its side in a ring binder 40 (FIG. 4) which holds the cards at their side edge which is designed for cards of that size. Recordplate Co. makes a binder 40 and it is commercially available.

The business information on the card 10 is printed within the first rectangular area or field 42 of standard calling card size, e.g. 2 × 3½ inches, bounded by the north edge 12 of the card 10 and a first arrangement of tear lines including the line of perforations 38 which parallels the east edge 14, a line of perforations 44 which parallels the south edge 16, and a line of perforations 46 which parallels the west edge 18 inside the west border 28.

It should now be noted that the card 10 is provided with a pair of T-shaped slots 48, spaced equal distances from one another with respect to the north-south extending transverse centerline of the card which results from severing the east and south borders therefrom along the lines of perforations 38 and 34 defining the third rectangular area including the second rectangular area. Each T-shaped slot 48 has a relatively narrow neck region 24 which joins the line of perforations 34 and extends northwards to a head portion 26 of generally rounded-corner square shape.

It should further be noted that the card 10 is provided with a third pair of T-shaped slots 50, spaced equal distances from one another with respect to the north-south extending transverse centerline of the card which results from severing the east and south borders therefrom along the lines of perforations 38 and 36 defining a second rectangular area including the first rectangular area. Each T-shaped slot 50 has a relatively narrow neck region 24 which joins the line of perforations 36 and extends northwards to a head portion 26 of generally rounded-corner square shape.

The lines of perforations 34, 36, 38, 44 and 46 and the T-shaped slots 22, 48 and 50 are provided using available techniques, e.g. die cutting. The card material which originally filled the slots 22, 48 and 50 may be designed to remain in place until the card is to be adjusted in size, e.g. by die cutting the slots with discontinuous die edges to define the slots with lines of perforations. Alternatively, some or all of the slots may be cleared of the original filling during the die cutting process of manufacture of the card.

Figure 2:
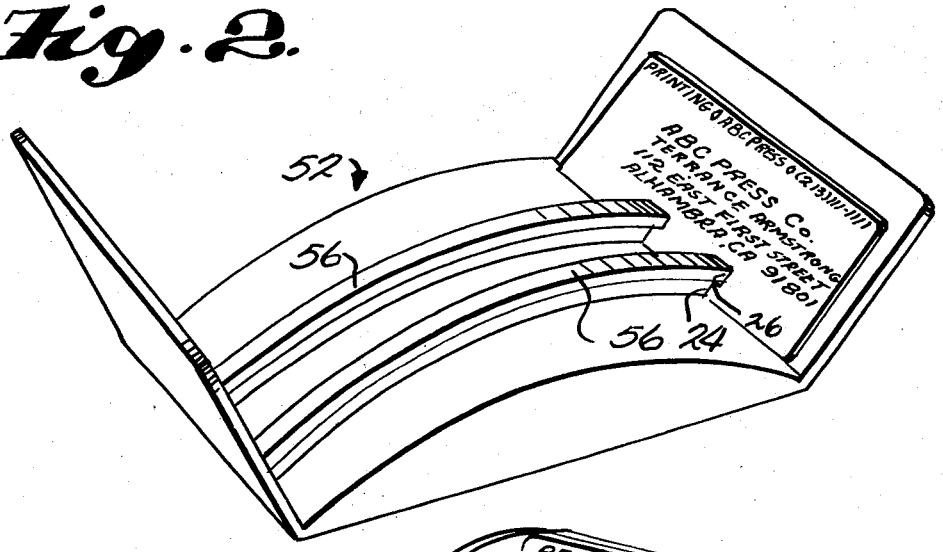
FIG. 2 shows a perspective view of an arched tray-type holder supplied with a card resulting from severing portions of the card shown in FIG. 1.
Figure 3:
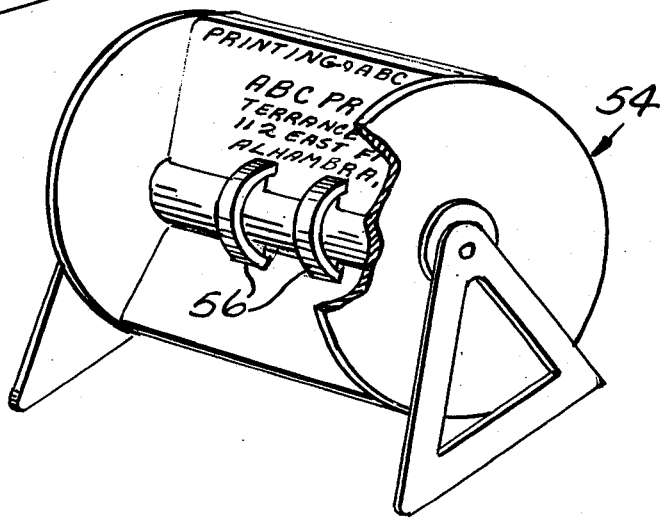
FIG. 3 shows a perspective view of a roll or wheel-type holder supplied with a card resulting from severing portions of the card shown in FIG. 1.

In FIGS. 2 and 3, two typical holders for dual T-slotted filing cards are shown at 52, 54. Each has a pair of T-shaped arcuate rails 56 which are mounted to the holder with their broadest portions outwards. The holders accommodate filing cards having slots 22, 48 or 50, when those slots open through an edge of the cards, by flexing the card stock enough to accommodate a rail 56 in each slot. The broad parts of the rails are received in the head portions 26 of the slots and the narrow portions of the rails extend through the necks 24. This permits the cards to be slid or rocked along the rails to permit the information on any card of interest to be readily seen.

In order to make use of a fourth filing device or holder 52 or 54 for 3 × 5 inch cards, no adjustment of the card 10 is necessary, although it would be necessary to remove the card material from the slots 22 if it had not been previously removed.

In order to makes use of a holder 52 or 54 for 2½ × 4 inch cards, the size of the card 10 is adjusted by severing along the lines of perforations 34 and 38. Now the slots 48 open through the south edge of the resulting card. If it had not been previously removed, it would be necessary to remove the card material from the slots 48.

In order to make use of a holder 52 or 54 for 2¼ × 4 inch cards, the size of the card 10 is adjusted by severing along the lines of perforations 38 and 36. Now the slots 50 open through the south edge of the resulting card. If it had not been previously removed, it would be necessary to remove the card material from the slots 50.

Figure 5:
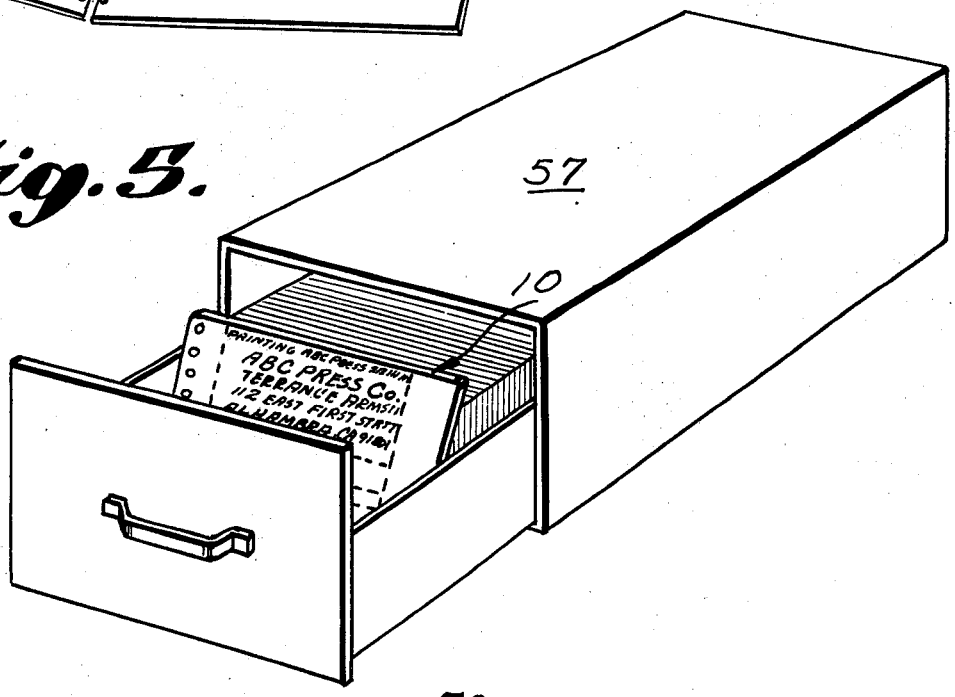
FIG. 5 shows a perspective view of a card index tray supplied with the card of FIG. 1 in its large format condition.

In FIG. 5, the card 10 is shown filed in a conventional 3 × 5 inch index card filing tray 57.

Figure 6:
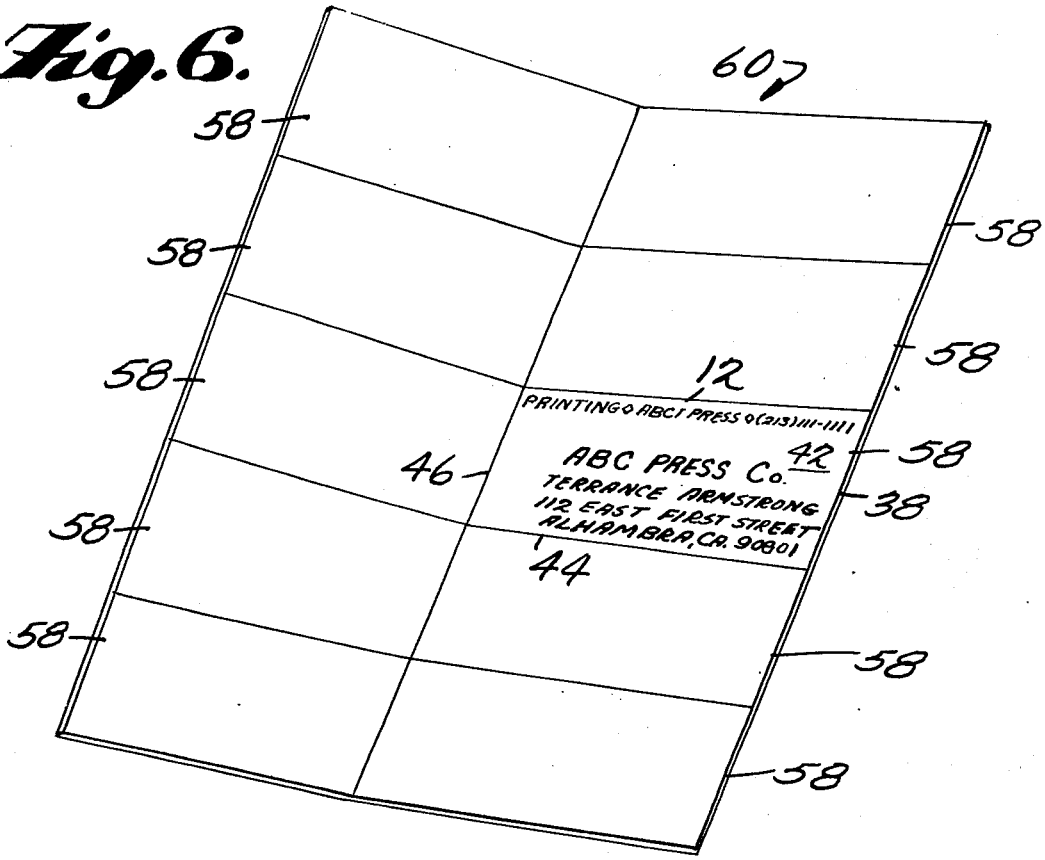
FIG. 6 shows a perspective view of a multiple plastic pocket-type of holder supplied with a calling card resulting from severing and discarding all but the rectangular, information-bearing region of the large format card shown in FIG. 1.

In FIG. 6, a calling card created by severing the field 42 from the card 10 along the lines of perforations 38, 44 and 46, is shown slipped in one pocket 58 of a multiple, transparent pocket calling card holder 60.

Figure 7:
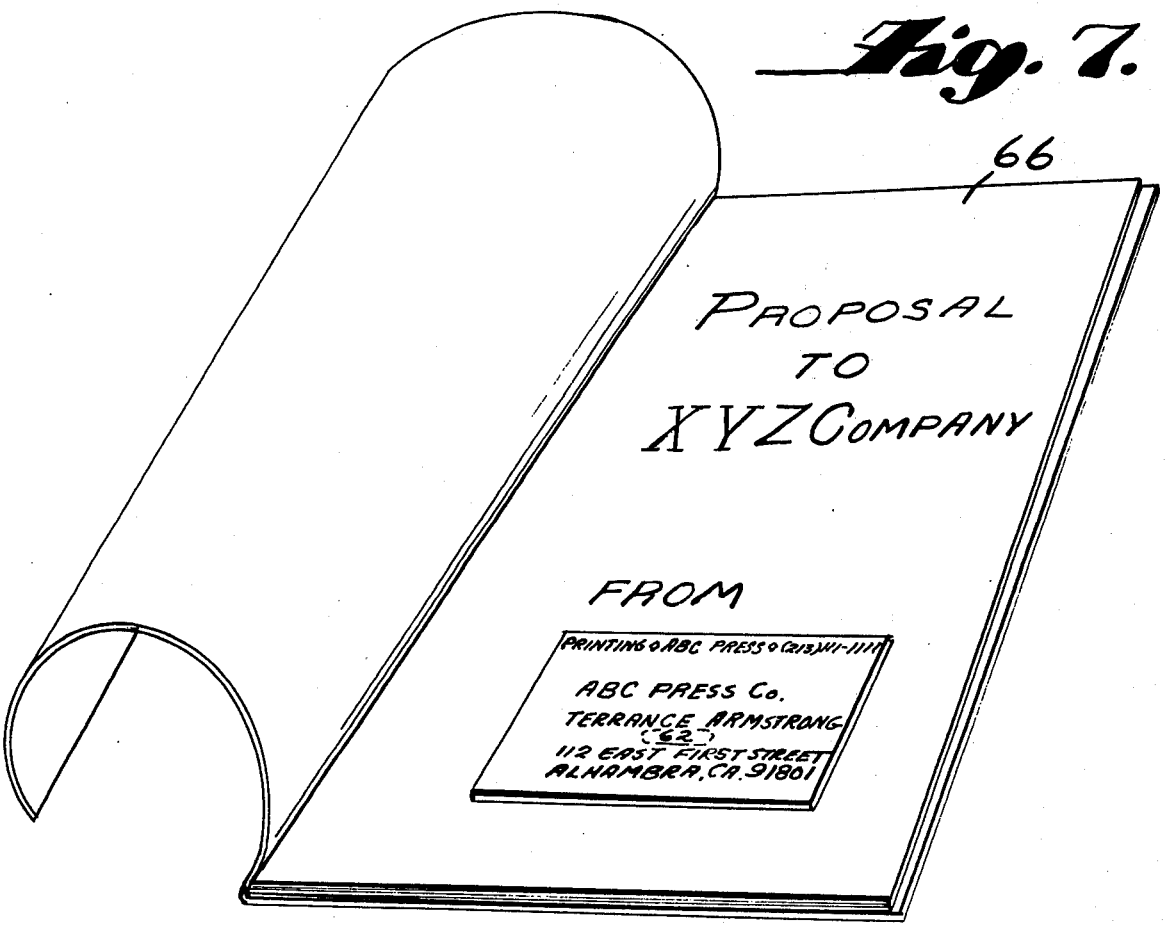
FIG. 7 shows a perspective view of a report bearing on its cover a calling card produced as in FIG. 6, but adhered to the cover by removing the temporary covering from area(s) of adhesive provided on the reverse side thereof.

The reverse face of the field 42 and/or the reverse face of all of the card 10 may be provided with one or more areas of applied adhesive, e.g. pressure sensitive adhesive 62 (FIGS. 1 and 7), initially inactivated, e.g. by being covered by a temporary covering, e.g. sheets of waxed paper 64. If it is desired to secure the card 10, or any resulting card, such as the calling card 42 to a surface, such as to the front cover 66 of a report, the sheets 64 are peeled off and the card is pressed to the surface to adhere the card to the surface via the adhesive 62. The area covered by adhesive 62 may extend over all of the reverse face of the card, or over any portion thereof.

As an alternative, the inactivated adhesive 62 may be one which is activated by moistening, in which case no temporary covering sheets 64 are needed.

Any of the corners of the card 10 or any of the resulting cards may be predetermined to be rounded, by appropriate provision of the shape of the cutting dies used to make the card edges and lines of perforation.

In the card embodiment shown in FIG. 1, all adjustments of the size of the card produce a resulting card which has at least part of the original north edge 12 as the north edge thereof. Although one edge of the original card should form the edge of the resulting cards, in order to minimize the amount of adjusting, such edge need not be the north edge. To illustrate that fact, another embodiment is shown in FIG. 8, wherein it is the south edge which remains.

Figure 8:
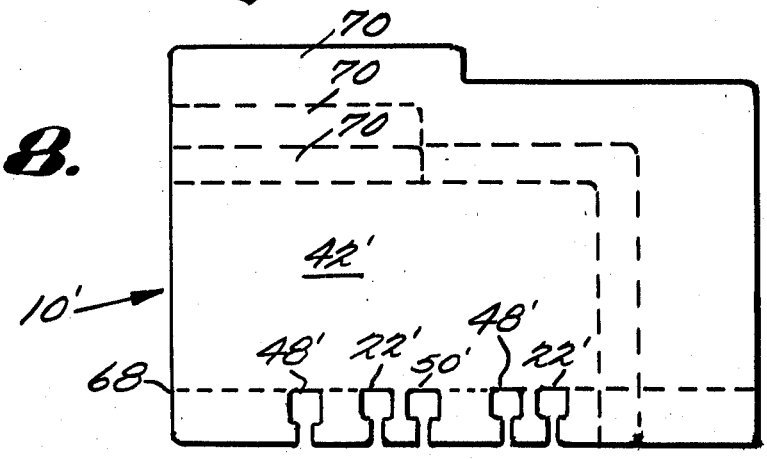
FIG. 8 shows another, presently less preferred embodiment of the large format card shown in FIG. 1.

For ease of understanding, corresponding numbering is used in FIGS. 1 and 8, except that in the latter instance, the numbers are primed.

Most noteworthy in FIG. 8 is that all the slots 22', 48' and 50' are open through the south edge of the card 10 from the beginning. A perforation line 68 may be provided extend along what would become the south edge of the calling card 10. In other instances, the perforation line 68 may be omitted.

As an added feature, the card 10' is shown provided with index tabs 70 at the west end of the north edge of the card 10' and of each resulting card (but the calling card 42').

While it is preferred that the guidelines for severing the large format card into any of the smaller size cards be constituted by lines of die cut perforations, some of them or all of them may be constituted by printed lines of dashes or equivalent guide means.

It should now be apparent that the business card system as described hereinabove possesses each of the attributes set forth in the specification under the heading "Summary of the Invention" hereinbefore. Because the business card system of the invention can be modified to some extent without departing from the principles of the invention as they have been outlined and explained in this specification, the present invention should be understood as encompassing all such modifications as are within the spirit and scope of the following claims.

What is claimed is:

1. An apparatus of the Class described comprising a main rectangular card greater in size than the size of a standard business card and having a top edge, a side edge and a bottom edge, a first region of said main rectangular card defined by a first arrangement of tear lines forming a first rectangular area the size of a business card, the first rectangular area of the main rectangular card adapted to have information printed thereon, said first arrangement of tear lines permitting said first rectangular area to be torn away from said main rectangular card whereby the information printed on the first rectangular area can be filed in a first filing device adapted to hold cards the size of business cards, a second region of said main rectangular card including said first rectangular area defined by a second arrangement of tear lines and forming a second generally rectangular area, said second arrangement of tear lines permitting said second rectangular area to be torn from said main rectangular card and filed in a second filing device that is larger than the first filing device and which holds cards the size of said second rectangular area, a third region of said rectangular area including said second rectangular area defined by a third arrangement of tear lines and forming a third generally rectangular area, said third arrangement of tear lines permitting said third rectangular area to be torn from said main rectangular card and filed in a third filing device that is larger than the second filing device and which holds cards the size of said third rectangular area, said main rectangular card the size of cards filed in a fourth filing device, said fourth filing device larger than the third filing device, whereby said main rectangular card with said information printed on said first rectangular area can be filed therein, the bottom of said second rectangular area being defined by one tear line and the bottom of said third rectangular area being defined by a second tear line, said first and second tear lines parallel to each other and parallel to and below the bottom edge of said first rectangular area, openings associated with said first and second tear lines, said openings conforming to the shape of the perforations formed in cards filed in said second and third filing devices, the bottom edge of said main rectangular card parallel to and below said first and second tear lines and having openings formed therein, said openings conforming to the shape of the perforations formed in cards filed in said fourth filing devices so that the information printed on the first rectangular area can be filed in said second, third or fourth filing devices which have devices which penetrate said openings and which hold cards at their bottom edge, and a second group of holes, said second group of holes being disposed in a line parallel to the side edge of said main rectangular card, and shaped and positioned so the information printed on said first rectangular area and including said second or third rectangular areas or said main rectangular card can be filed in filing devices which have devices which penetrate said holes and which hold cards by the side edge.

2. The main rectangular card described in claim 1 wherein the openings are "T" shaped and are associated with said first and second tear lines and the bottom edge of the main rectangular card, two "T" shaped openings communicating with the second tear lines, two with the third tear line and two with the bottom edge of the main rectangular card respectively, said "T" shaped openings in said second tear line, said third tear line, and the bottom edge of said main rectangular card spaced so they conform to the spacing of "T" shaped perforations formed in cards filed in the second, third and fourth filing devices.

3. The main rectangular card described in claim 1 wherein the second group of holes are circular.

4. The main rectangular card described in claim 1 wherein adhesive material is secured to the back of a portion of the main rectangular card whereby the main rectangular card or the first, second, third or fourth rectangular areas may be adhesively secured to a sheet.

5. The main rectangular card described in claim 4 wherein said adhesive material is secured to the back of said first rectangular area of said main rectangular card whereby the first rectangular area of the main rectangular card is adhesively secured to a sheet.

* * * * *